US011067079B2

(12) United States Patent
Jo et al.

(10) Patent No.: US 11,067,079 B2
(45) Date of Patent: Jul. 20, 2021

(54) SCROLL COMPRESSOR

(71) Applicant: LG ELECTRONICS INC., Seoul (KR)

(72) Inventors: Changeol Jo, Seoul (KR); Suchul Kim, Seoul (KR); Donghyun Sohn, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 108 days.

(21) Appl. No.: 16/660,044

(22) Filed: Oct. 22, 2019

(65) Prior Publication Data

US 2020/0158109 A1 May 21, 2020

(30) Foreign Application Priority Data

Nov. 16, 2018 (KR) ..... 10-2018-0142077

(51) Int. Cl.
*F04C 18/02* (2006.01)
*F04C 29/00* (2006.01)
*F04C 27/00* (2006.01)

(52) U.S. Cl.
CPC ..... *F04C 18/0215* (2013.01); *F04C 29/0021* (2013.01); *F04C 29/0057* (2013.01); *F04C 27/005* (2013.01)

(58) Field of Classification Search
CPC ..... F04C 18/0215; F04C 29/0057; F04C 29/0071; F04C 29/0021; F04C 27/005; F01C 17/063
See application file for complete search history.

(56) References Cited

U.S. PATENT DOCUMENTS 4,795,323 A * 1/1989 Lessie ..... F01C 17/063 418/55.3
5,102,316 A * 4/1992 Caillat ..... F01C 19/08 418/55.5

(Continued)

FOREIGN PATENT DOCUMENTS

JP 58-30403 2/1983
JP 2011-052603 3/2011
JP 2014-240641 12/2014

(Continued)

OTHER PUBLICATIONS

European Search Report dated Dec. 4, 2019.
Korean Office Action dated Jan. 21, 2020.

*Primary Examiner* — Mark A Laurenzi
*Assistant Examiner* — Xiaoting Hu
(74) *Attorney, Agent, or Firm* — Ked & Associates LLP

(57) ABSTRACT

A scroll compressor is provided that may include a frame; a non-orbiting scroll provided with a non-orbiting wrap formed on a first side surface of a non-orbiting end plate in an axial direction; an orbiting scroll provided with an orbiting wrap formed on a first side surface of the orbiting end plate in the axial direction and engaged with the non-orbiting wrap to form a compression chamber; a plurality of first guides disposed between the frame and the non-orbiting scroll to be located radially outward from the non-orbiting wrap; and a plurality of second guides provided on the orbiting end plate to be located radially outward from the orbiting wrap, respectively, so as to allow an orbiting motion of the orbiting scroll together with the first guides.

20 Claims, 14 Drawing Sheets

(56) References Cited

U.S. PATENT DOCUMENTS

| | | | | |
|---|---|---|---|---|
| 2012/0164014 | A1* | 6/2012 | Nagahara | F04C 27/005 418/55.1 |
| 2015/0316053 | A1* | 11/2015 | Han | F04C 18/0215 418/55.3 |

FOREIGN PATENT DOCUMENTS

| | | |
|---|---|---|
| KR | 10-0186867 | 12/1998 |
| KR | 10-2009-0027348 | 3/2009 |
| KR | 10-0922122 | 10/2009 |
| KR | 10-2015-0126499 | 11/2015 |

* cited by examiner

SCROLL COMPRESSOR

CROSS-REFERENCE TO RELATED APPLICATION(S)

Pursuant to 35 U.S.C. § 119(a), this application claims the benefit of an earlier filing date of and the right of priority to Korean Patent Application No. 10-2018-0142077, filed in Korea on Nov. 16, 2018, the contents of which are incorporated by reference herein in its entirety.

BACKGROUND

1. Field

A scroll compressor, and more particularly, an anti-rotation mechanism of a scroll compressor, capable of preventing rotation of an orbiting scroll are disclosed herein.

2. Background

A scroll compressor is configured such that an orbiting scroll and a non-orbiting scroll are engaged with each other and a pair of compression chambers is formed while the orbiting scroll performs an orbiting motion with respect to the non-orbiting scroll. The orbiting scroll is coupled to a rotational shaft to receive a rotational force. However, the orbiting scroll performs the orbiting motion, without performing a rotational motion, by virtue of an anti-rotation mechanism which is disposed between the orbiting scroll and a frame (or the non-orbiting scroll) facing the orbiting scroll.

Anti-rotation mechanisms are well known and classified into an Oldham ring type and a pin-and-ring type. In the Oldham ring type, a key is formed on an Oldham ring having an annular shape, and key grooves in which the key is slidably inserted are formed in the orbiting scroll and the frame in directions orthogonal to each other. Accordingly, the key suppresses rotation of the orbiting scroll while orthogonally moving within the key grooves. On the other hand, in the pin-and-ring type, a plurality of pins is formed on one of the orbiting scroll or the frame and coupled to a plurality of rings, which is formed in the other to perform an orbiting motion, thereby preventing rotation of the orbiting scroll. Korean Patent Laid-Open Publication No. 10-2015-0126499 (hereinafter, "Patent Document 1"), published on Nov. 12, 2015, discloses an Oldham ring type, and Japanese Patent Laid-Open Publication No. 2014-240641 (hereinafter, "Patent Document 2"), published on Dec. 25, 2014, discloses a pin-and-ring type. Patent Document 1 and Patent Document 2 are hereby incorporated by reference.

However, in the related art scroll compressor, if the anti-rotation mechanism is configured as a separate Oldham ring or pin-and-ring structure, the number of components of the compressor is increased, and thus, fabricating costs are increased. As the number of components is increased, the number of assembly processes is increased, and thus, the possibility of an assembly error is increased. This causes a problem of lowering reliability of the compressor.

Further, in the related art scroll compressor, after the anti-rotation mechanism is aligned and assembled between the frame and the orbiting scroll, the non-orbiting scroll should be assembled to the frame while aligned with the orbiting scroll. This makes an assembling operation complicated and difficult.

Furthermore, in the related art scroll compressor, as the anti-rotation mechanism is disposed between the orbiting scroll and the frame, it is difficult to form a back pressure chamber between the orbiting scroll and the frame. Accordingly, the related art has employed a non-orbiting back pressure method in which a separate back pressure chamber assembly is disposed at an upper surface side of the non-orbiting scroll to press the non-orbiting scroll toward the orbiting scroll. However, in the non-orbiting back pressure method, the addition of the back pressure chamber assembly results in requiring a separate guide member to guide movement of the orbiting scroll in an axial direction, thereby increasing manufacturing costs. On the other hand, in an orbiting back pressure method in which a back pressure chamber is formed between the orbiting scroll and the frame, the anti-rotation mechanism is disposed between the orbiting scroll and the frame. This limits a volume of the back pressure chamber, causing unstable behavior of the orbiting scroll, and leakage between compression chambers is likely to occur.

BRIEF DESCRIPTION OF THE DRAWINGS

Embodiments will be described in detail with reference to the following drawings in which like reference numerals refer to like elements, and wherein.

DETAILED DESCRIPTION

Figure 1:
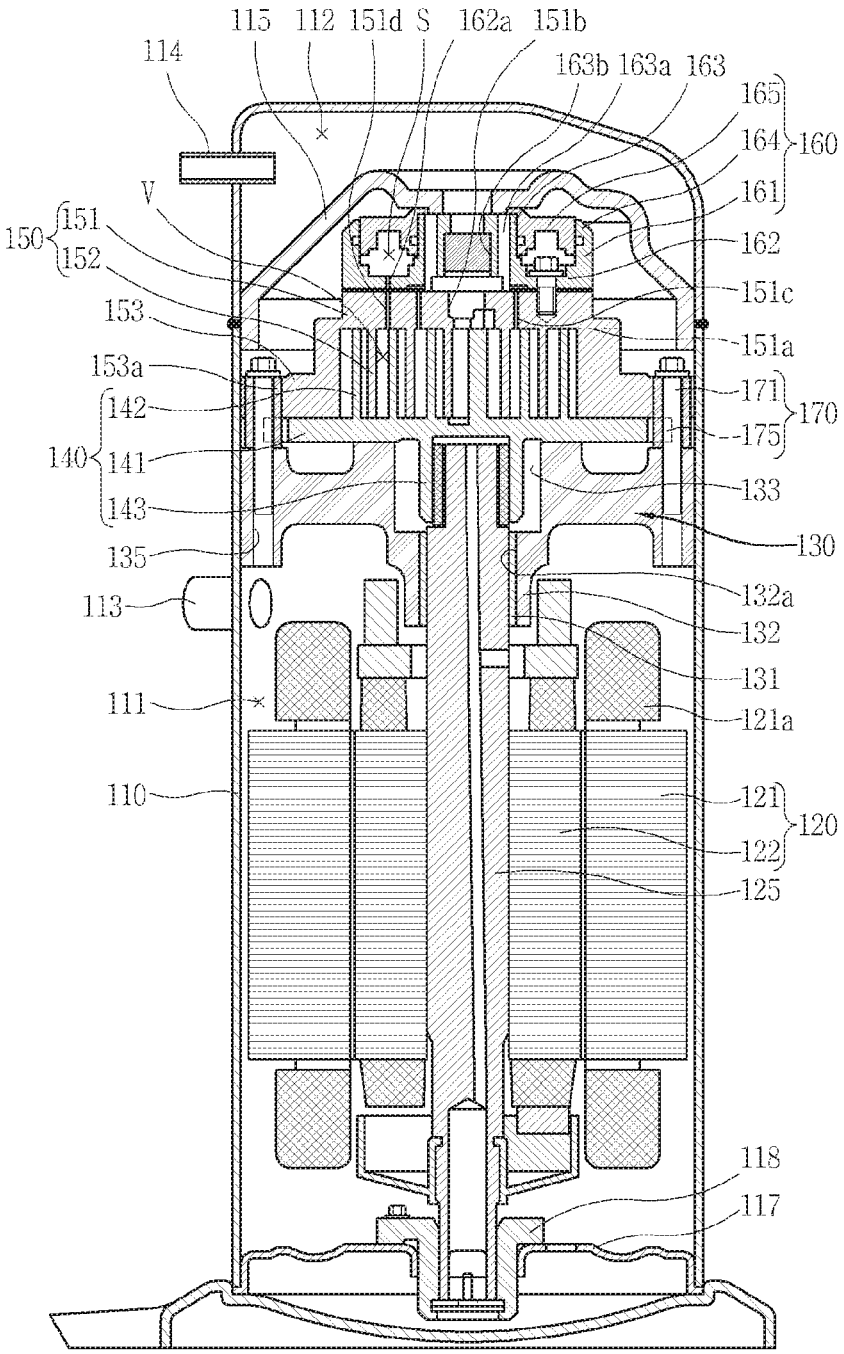
FIG. 1 is a longitudinal cross-sectional view of a capacity-variable scroll compressor in accordance with an embodiment.

Description will now be given for a scroll compressor according to embodiments disclosed herein, with reference to the accompanying drawings. Wherever possible, the same or like reference numerals have been used to indicate the same or like elements, and repetitive disclosure has been omitted.

FIG. 1 is a longitudinal sectional view of a capacity-variable scroll compressor in accordance with an embodiment. Referring to FIG. 1, in a scroll compressor according to an embodiment, an inner space of a casing 110 is sealed, and a suction space 111, which is a low pressure portion, and a discharge space 112, which is a high pressure portion, are divided by a high and low pressure separation plate 115. The high and low pressure separation plate 115 is provided above a non-orbiting scroll 150 described hereinafter. Accordingly, the suction space 111 corresponds to a lower space of the high and low pressure separating plate 115, and the discharge space 112 corresponds to an upper space of the high and low pressure separation plate 115. A suction pipe 113 communicates with the suction space 111 of the casing 110, and a discharge pipe 114 communicates with the discharge space 112 of the casing 110.

In the suction space 111 of the casing 110, a drive motor 120 including a stator 121 and a rotor 122 may be installed. The stator 121 may be, for example, shrink-fixed to an inner wall surface of the casing 110, and the rotor 122 may be rotatably provided inside of the stator 121.

A coil 121*a* may be wound around the stator 121. The coil 121*a* may be electrically connected to an external power source through a terminal (not shown) coupled through the casing 110. A rotational shaft 125 may be inserted into a central portion of the rotor 122.

An upper end portion or end of the rotational shaft 125 and a lower end portion or end of the rotational shaft 125 may be rotatably inserted into a main frame 130 and a sub frame 117, respectively, so as to be supported in a radial direction. Bush bearings 131 and 118 that support the rotational shaft 125 may be fixedly inserted into the main frame 130 and the sub frame 117, respectively.

The main frame 130 may be fixedly coupled to the inner wall surface of the casing 110, similar to the sub frame 117. A main bearing portion or bearing 132 in which the rotational shaft 125 may be inserted may extend from a lower surface of the main frame 130 to protrude downward. The main bearing portion 132 may have a bearing hole 132*a* formed therethrough in an axial direction so that the rotational shaft 125 may be inserted, and bush bearing 131 may be fixedly inserted into an inner circumferential surface of the bearing hole 132*a*.

An orbiting space 133 in which a boss portion or boss 143 of an orbiting scroll 140 performs an orbiting motion may be formed in an upper end portion or end of the main bearing portion 132. The orbiting space 133 may be formed by recessing an upper surface of the main frame 130.

A coupling hole 135 to which a first guide 171 described hereinafter may be coupled may be formed in an upper surface of the main frame 130. A plurality of the coupling hole 135 may be provided, formed outside the orbiting space 133 and spaced apart by preset or predetermined intervals along a circumferential direction. The coupling hole 135 may correspond to a guide hole 153*a* described hereinafter.

The orbiting scroll 140 may be disposed on an upper surface of the main frame 130. The orbiting scroll 140 may include an orbiting end plate portion or plate 141 having a substantially disc shape, and an orbiting wrap 142 spirally formed on one surface of the orbiting end plate portion 141. The boss portion or boss 143 to which the rotational shaft 125 may be coupled may be formed on a lower surface of the orbiting end plate portion 141. The orbiting wrap 142 forms a compression chamber V together with a non-orbiting wrap 152 of the non-orbiting scroll 150 described hereinafter.

The orbiting scroll 140 performs the orbiting motion between the main frame 130 and the non-orbiting scroll 150. First guide 171 may be provided between the main frame 130 and the non-orbiting scroll 150, and a second guide 175 may be provided on the orbiting scroll 140. The first guide 171 and the second guide 175 may be coupled to move relative to each other, thereby suppressing rotation of the orbiting scroll 140. This will be described hereinafter.

The non-orbiting scroll 150 may be disposed on the orbiting scroll 140. The non-orbiting scroll 150 may be installed to be movable up and down with respect to the orbiting scroll 140. A plurality of the first guides 171, which may be inserted into the main frame 130, may be placed in a supported manner on an upper surface of the main frame 130 in a state of being inserted into a plurality of the guide holes 153*a* formed through an outer circumferential portion of the non-orbiting scroll 150.

The non-orbiting scroll 150 may include a non-orbiting end plate portion or plate 151 formed in a disc shape, and the non-orbiting wrap 152 provided on a lower surface of the non-orbiting end plate portion 151 to be engaged with the orbiting wrap 142. A suction port 151*a* through which a refrigerant existing in the suction space 111 may be introduced may be formed through a side surface of the non-orbiting end plate portion 151, and a discharge port 151*b* through which a compressed refrigerant may be discharged may be formed through an approximately central portion of the non-orbiting end plate portion 151. A bypass hole 151*c* may be formed between the suction port 151*a* and the discharge port 151*b* to bypass a portion of a refrigerant to be compressed to prevent over-compression of the refrigerant. A scroll-side back pressure hole (hereinafter, "first back pressure hole") 151*d* may be formed between the bypass hole 151*c* and the suction port 151*a*, so that compression chamber V and a back pressure chamber S may communicate with each other through a plate-side back pressure hole (hereinafter, "second back pressure hole") 162*a* described hereinafter. Accordingly, the first back pressure hole 151*d* may communicate with the compression chamber V having an intermediate pressure between a suction pressure and a discharge pressure.

In addition, a plurality of sliding protrusions 153 may be formed on an outer circumferential surface of the non-orbiting end plate portion 151 along the circumferential direction. Guide holes 153*a* described above may be formed through the sliding protrusions 153, respectively.

A back pressure chamber assembly 160 forming the back pressure chamber S may be installed on an upper side of the non-orbiting scroll 150. Accordingly, the non-orbiting scroll 150 may be pressed toward the orbiting scroll 140 by back pressure of the back pressure chamber S (accurately, internal pressure of the back pressure chamber) to seal the compression chamber V.

The back pressure chamber assembly 160 may include a back pressure plate 161 coupled to an upper surface of the non-orbiting end plate portion 151, and a floating plate 165 slidably coupled to the back pressure plate 161 to form the back pressure chamber S together with the back pressure plate 161. The back pressure plate 161 may be coupled to the upper surface of the non-orbiting end plate portion 151 by a plurality of bolts 160*b* along the circumferential direction. The plurality of bolts 160*b* may be inserted through the back pressure plate 161 in the back pressure chamber S so as to be coupled to the non-orbiting end plate portion 151.

The back pressure plate 161 may include a support plate portion or plate 162 brought into contact with the non-orbiting end plate portion 151. The support plate portion 162 may be formed in a shape of an annular plate with a hollow center, and the second back pressure hole 162*a* communicating with the first back pressure hole 151*d* described above may be formed through the support plate portion 162 in the axial direction.

A first annular wall 163 and a second annular wall 164 may be formed on an upper surface of the support plate portion 162 so as to surround an inner circumferential surface and an outer circumferential surface of the support plate portion 162. An outer circumferential surface of the first annular wall 163, an inner circumferential surface of the second annular wall 164, the upper surface of the support plate portion 162, and a lower surface of the floating plate 165 may form the back pressure chamber S in an annular shape.

The first annular wall 163 may be provided with an intermediate discharge port 163*a* communicating with the discharge port 151*b* of the non-orbiting scroll 150, and a valve guide groove 163*b* in which a check valve 155 may be slidably inserted may be formed in the intermediate discharge port 163*a*. The check valve 155 may be selectively opened and closed between the discharge port 151*b* and the intermediate discharge port 163*a* to suppress a discharged refrigerant from flowing back into the compression chamber V.

The floating plate 165 may be formed in an annular shape and may be formed of a lighter material than the back pressure plate 161. Accordingly, the floating plate 165 may be attached to and detached from a lower surface of the high and low pressure separation plate 115 while moving in the axial direction with respect to the back pressure plate 161 depending on the pressure of the back pressure chamber S. For example, when the floating plate 165 is brought into contact with the high and low pressure separation plate 115, a gap between the discharge space 112 and the suction space 111 may be sealed so that refrigerant discharged into the discharge space 112 may be prevented from leaking into the suction space 111.

In the drawings, unexplained reference numeral 130*a* denotes a thrust surface.

The scroll compressor according to this embodiment may operate as follows.

When power is applied to the coil 121*a* of the stator 121, the rotor 122 rotates, and the rotational shaft 125 coupled to the rotor 122 rotates together with the rotor 122. Then, the orbiting scroll 140 coupled to the rotational shaft 125 performs the orbiting motion with respect to the non-orbiting scroll 150, thereby forming a pair of compression chambers V between the orbiting wrap 142 and the non-orbiting wrap 152. Each of the pair of compression chambers V is reduced in volume while moving from outside to inside, thereby suctioning, compressing, and discharging a refrigerant. The compressed refrigerant is partially moved into the back pressure chamber S through the first back pressure hole 151*d* and the second back pressure hole 162*a* before reaching the discharge port 151*b*. Accordingly, the back pressure chamber S formed by the back pressure plate 161 and the floating plate 165 forms an intermediate pressure.

Then, the floating plate 165 is subjected to pressure applied upward and thereby is brought into close contact with the high and low pressure separation plate 115. Accordingly, the discharge space 112 and the suction space 111 of the casing 110 are separated from each other, so as to prevent the refrigerant discharged into the discharge space 112 from leaking into the suction space 111. The back pressure plate 161 is pressed downward to press the non-orbiting scroll 150 in the direction toward the orbiting scroll 140. Accordingly, the non-orbiting scroll 150 is closely adhered to the orbiting scroll 140 to seal a gap between the compression chambers V, thereby preventing the refrigerant from leaking from a high-pressure compression chamber to a low-pressure compression chamber.

As described above, the refrigerant suctioned into the suction space 111 of the casing 110 is compressed in the compression chamber V and discharged into the discharge space 112. The refrigerant may then circulate along a refrigeration cycle and then may be suctioned back into the suction space 111. Such series of processes may be repeatedly performed.

As described above, in the scroll compressor, when the compressor operates, the non-orbiting scroll and the orbiting scroll may be separated in the axial direction by a gas force of a compressed refrigerant. Accordingly, a non-orbiting back pressure method for pressing (pushing) the non-orbiting scroll toward the orbiting scroll, or conversely, an orbiting back pressure method of pressing the orbiting scroll toward the non-orbiting scroll is known.

In the non-orbiting back pressure method, the back pressure chamber assembly is installed on the rear surface of the non-orbiting scroll, which facilitates an increase in volume of the back pressure chamber. Accordingly, pressure of the back pressure chamber can be made uniform, thereby reducing compression loss. In the orbiting back pressure method, as the orbiting scroll is spaced apart from the frame, an overall frictional loss may be reduced and manufacturing costs may be reduced by virtue of a simple structure.

However, the non-orbiting back pressure method increases manufacturing costs due to an addition of a member for guiding axial movement of the back pressure chamber assembly and the non-orbiting scroll, and the orbiting back pressure method may be limited in the volume of the back pressure chamber due to the anti-rotation mechanism.

Thus, embodiments illustrates that the anti-rotation mechanism is formed at the outer side of the orbiting scroll to easily and simply form the anti-rotation mechanism in the scroll compressor to which the non-orbiting back pressure method or the orbiting back pressure method is applied.

Figure 2:
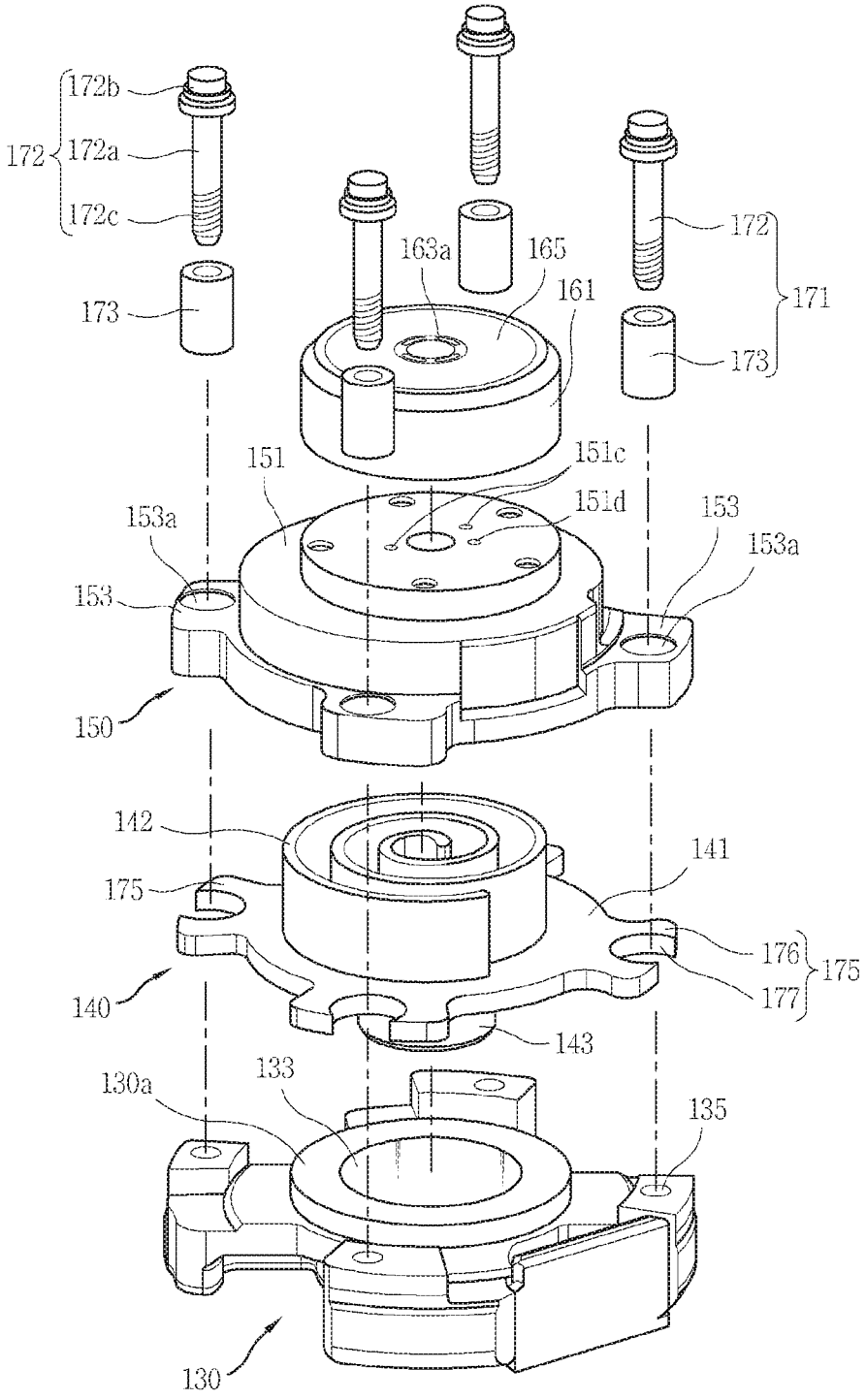
FIG. 2 is an exploded perspective view of a compression device for explaining an anti-rotation mechanism, in the scroll compressor according to FIG. 1.
Figure 3:
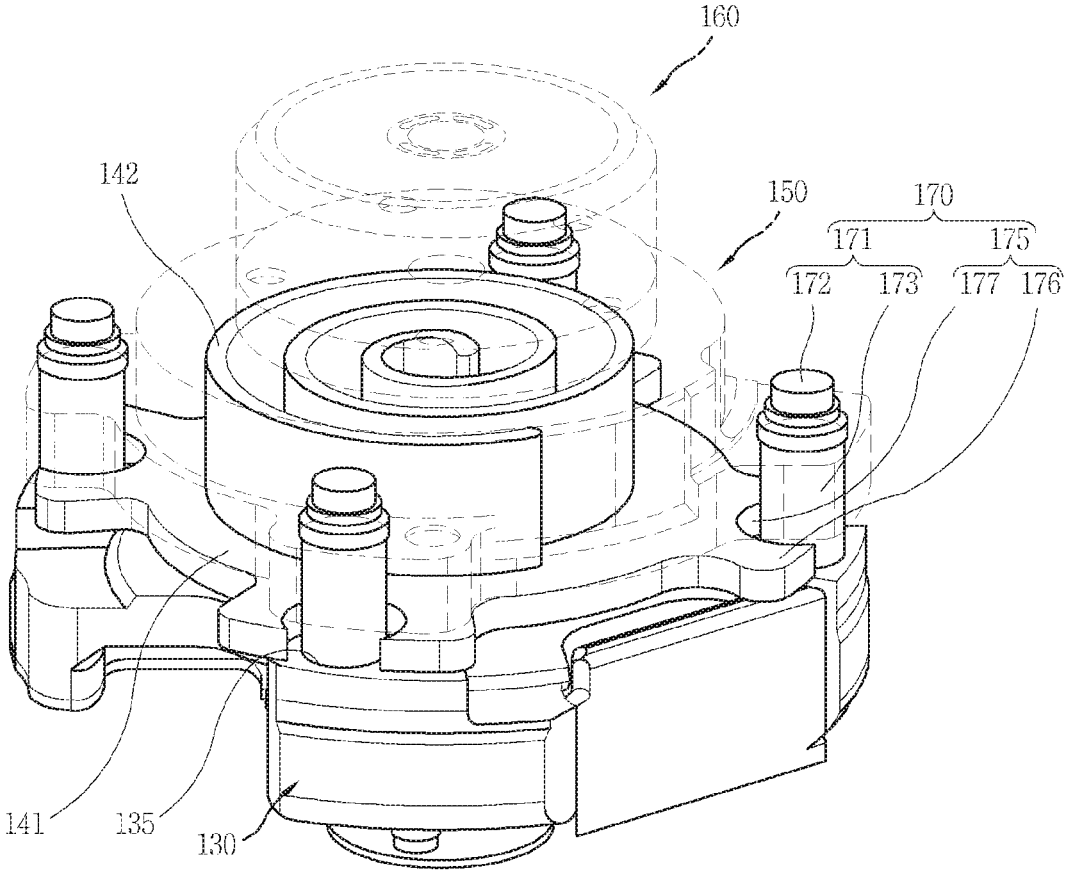
FIG. 3 is a perspective view illustrating an assembled compression device in the scroll compressor according to FIG. 2.
Figure 4:
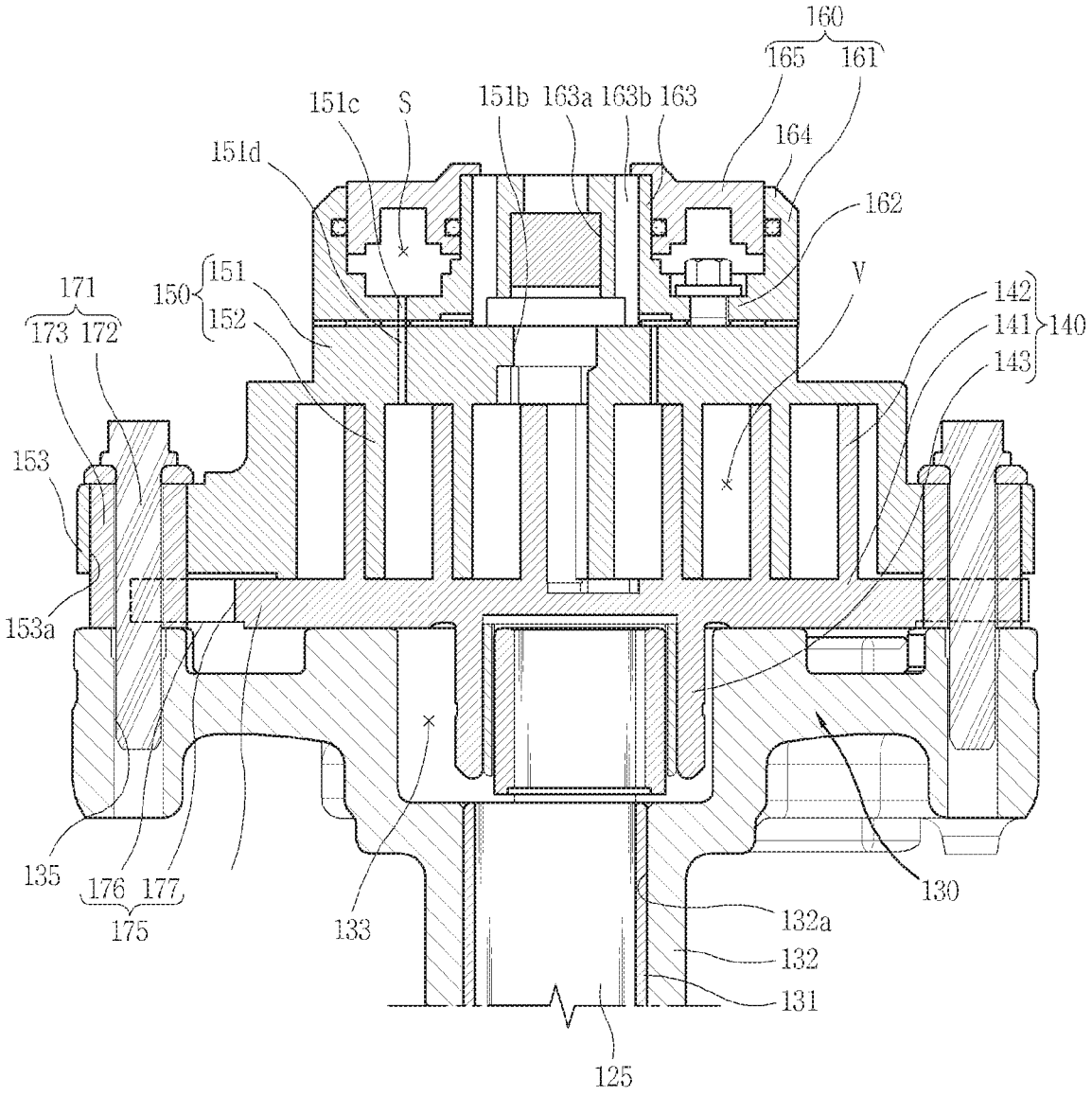
FIG. 4 is a cross-sectional view illustrating an assembled compression device, in the scroll compressor according to FIG. 3.

FIG. 2 is an exploded perspective view of a compression device for explaining an anti-rotation mechanism, in the scroll compressor according to FIG. 1. FIG. 3 is a perspective view illustrating the assembled compression device in the scroll compressor according to FIG. 2. FIG. 4 is a cross-sectional view illustrating an assembled compression device, in the scroll compressor according to FIG. 3.

Referring to these drawings, an anti-rotation mechanism 170 according to this embodiment may include a plurality of the first guides 171 provided between the frame 130 and the non-orbiting scroll 150, and a plurality of the second guides 175 provided on the orbiting end plate portion 141 for allowing the orbiting scroll 140 to perform the orbiting motion together with the first guides 171. The plurality of first guides 171 may be located outward from the non-orbiting wrap 152 in the radial direction, and spaced apart by preset intervals or predetermined along a circumferential direction. In this embodiment, four first guides 171 are provided at approximately 90° intervals.

For example, each of the first guides 171 may include a pin 172 inserted through the non-orbiting end plate portion 151 to be coupled to the frame 130, and a bush member or bushing 173 inserted into an outer circumferential surface of the pin 172 to be disposed between the frame 130 and the non-orbiting scroll 150.

The pin 172 may be provided with a pin portion 172*a* formed in a shape of a rod, a fixing head portion 172*b* formed on one or a first end of the pin portion 172*a*, and a first coupling screw portion 172*c* formed on another or a second end of the pin portion 172*a*. The fixing head portion 172*b* may be axially supported on an upper surface of the non-orbiting scroll 150 in the axial direction. The pin portion 172*a* may be slidably inserted into the guide hole 153*a* of the non-orbiting scroll 150. The first coupling screw portion 172*c* may be screwed into the coupling hole 135 provided in the frame 130. The pin portion 172*a* may be rotatably coupled through the bushing 173.

An upper end of the bushing 173 may be inserted into the guide hole 153*a* of the non-orbiting scroll 150 to be supported by the fixing head portion 172*b* of the pin 172, and a lower end of the bushing 173 may be supported by the upper surface of the frame 130. Accordingly, the frame 130 and the non-orbiting scroll 150 may be spaced apart from each other by a predetermined interval, thereby defining a space in which the orbiting scroll 140 may perform the orbiting motion between the frame 130 and the non-orbiting scroll 150.

In addition, the bushing 173 may be coupled to the second guide 175 described hereinafter in a manner that an outer circumferential surface of the bushing 173 may be surrounded by a guide accommodating portion 177 of the second guide 175. The bushing 173 may be brought into contact with the guide accommodating portion 177 to substantially play a role of a guide for suppressing a rotary motion of the orbiting scroll 140. Accordingly, the bushing 173 may be formed of a material, which is easily processed and has a low friction coefficient, in consideration of friction with the second guide 175.

Figure 5:
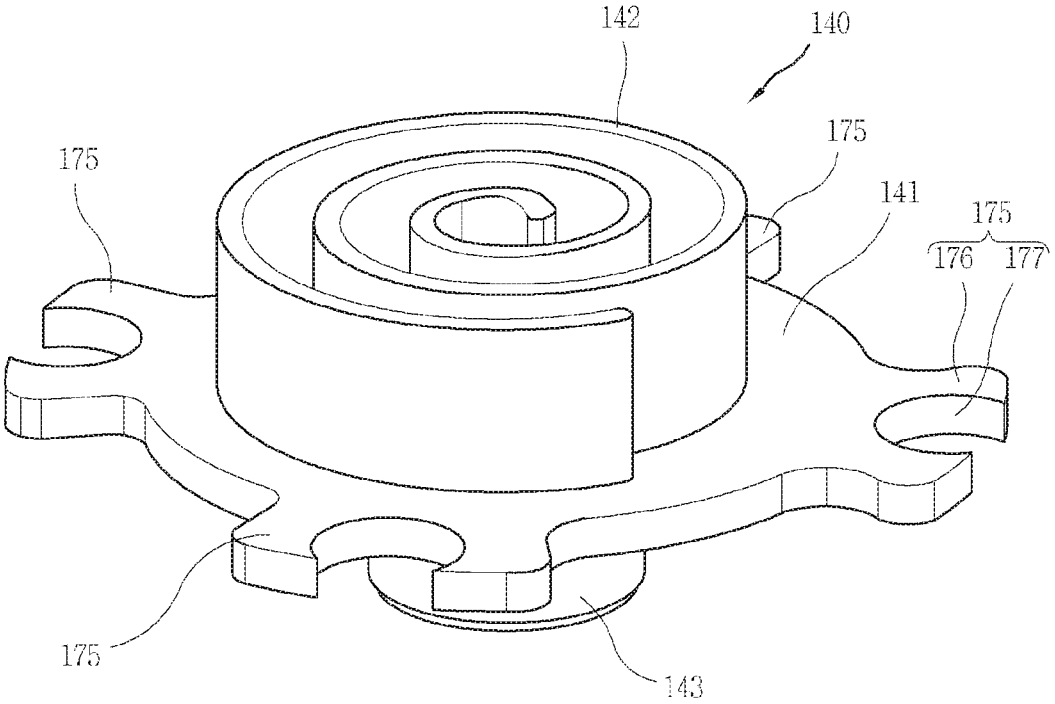
FIG. 5 is a perspective view of an orbiting scroll in accordance with an embodiment.
Figure 6:
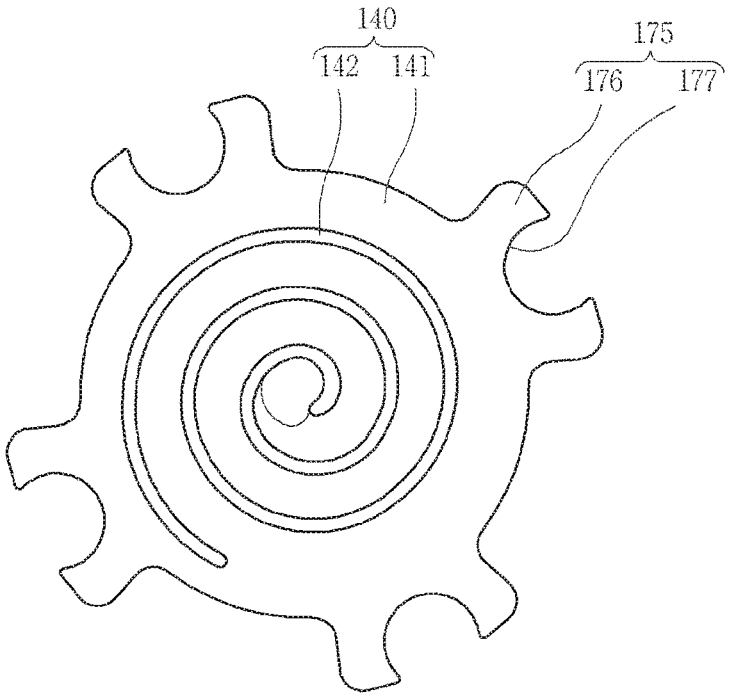
FIG. 6 is a planar view illustrating an upper surface of the orbiting scroll according to FIG. 5.
Figure 7:
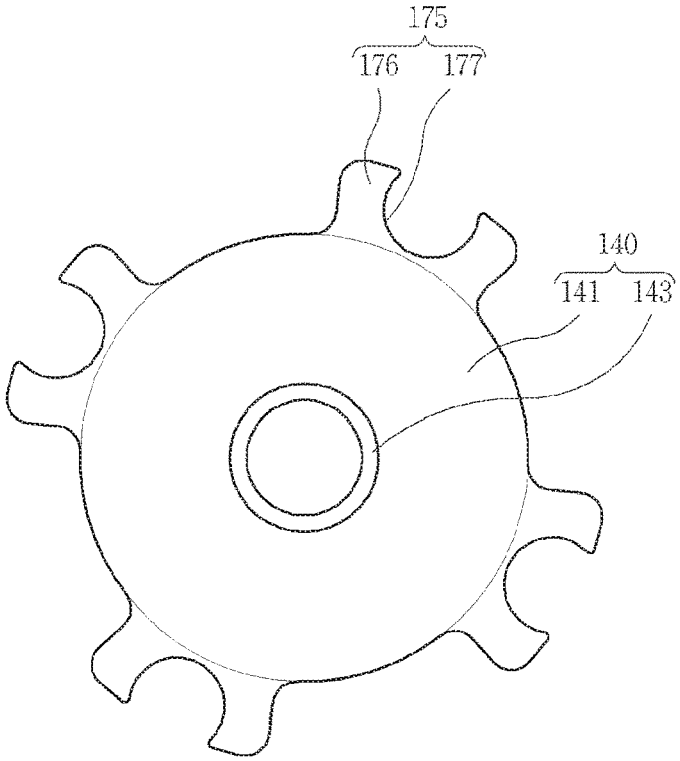
FIG. 7 is a planar view illustrating a lower surface of the orbiting scroll according to FIG. 5.

FIG. 5 is a perspective view of an orbiting scroll in accordance with an embodiment. FIG. 6 is a planar view illustrating an upper surface of the orbiting scroll according to FIG. 5. FIG. 7 is a planar view illustrating a lower surface of the orbiting scroll according to FIG. 5.

Referring to FIGS. 5 to 7, as described above, the orbiting scroll 140 may be formed such that the orbiting wrap 142 is formed on the upper surface of the orbiting end plate portion 141 and the lower surface of the orbiting end plate portion 141 may be formed flat except for the boss portion 143 due to elimination of a key groove or a pin (or ring) provided in the related art. Instead, the second guides 175 may be formed at the outer circumferential surface of the orbiting end plate portion 141.

The second guides 175 may be located outward from the orbiting wrap 142 in the radial direction, and spaced apart by preset or predetermined intervals along the circumferential direction so as to be coupled to the first guides 171, respectively. Therefore, in this embodiment, similar to the first guides 171, the second guides 175 may be spaced apart by approximately 90° intervals.

In addition, the second guides 175 may extend so as to protrude radially from the outer circumferential surface of the orbiting end plate portion 141. However, in some cases, the second guides 175 may alternatively be formed inward from the outer circumferential surface of the orbiting end plate portion 141. For example, when the second guides 175 are formed inward from the outer circumferential surface of the orbiting end plate portion 141, the orbiting end plate portion 141 may be formed in a circular shape. Then, a motion space for the orbiting end plate portion 141 which may be as wide as an orbiting radius in the radial direction is required in the inner space of the casing 110. This causes an increase in the inner diameter of the casing 110, and thereby the overall size of the compressor becomes large. Therefore, in consideration of the size of the compressor, the second guides 175 may protrude from the outer circumferential surface of the orbiting end plate portion 141.

Figure 8:
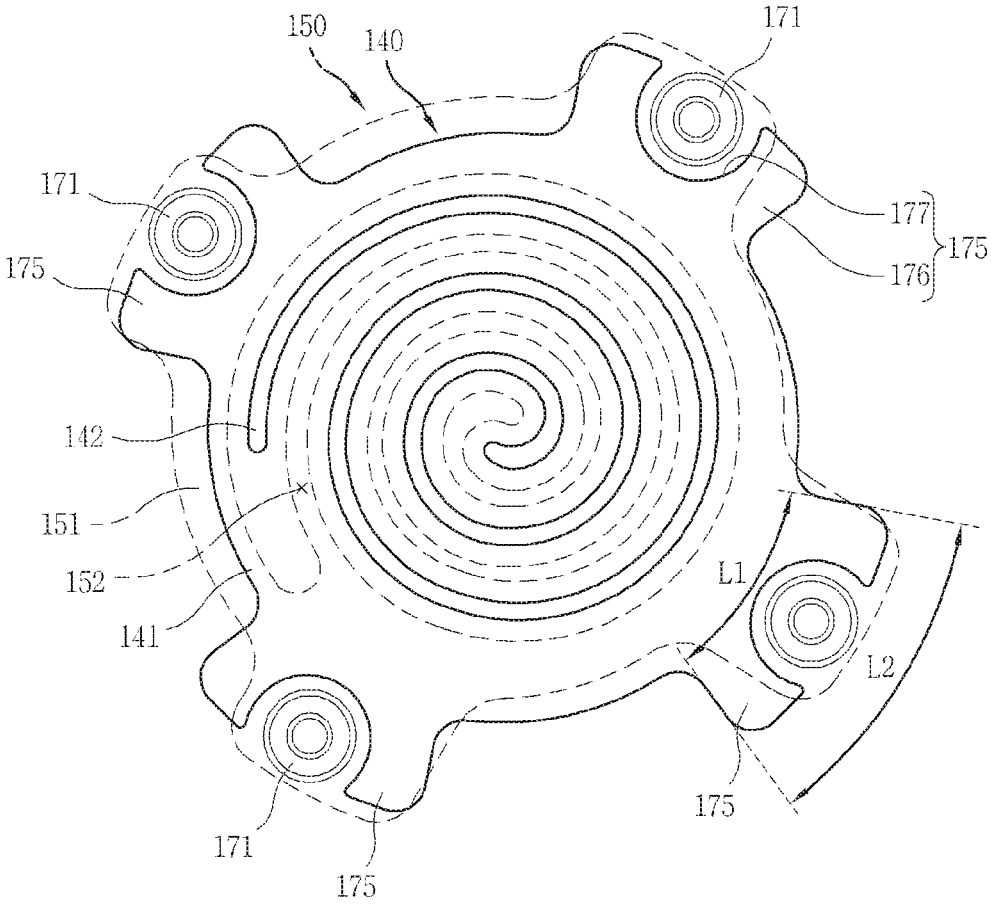
FIG. 8 is a planar view illustrating a state in which an orbiting scroll and a non-orbiting scroll are concentrically coupled to each other, in accordance with an embodiment.
Figure 9:
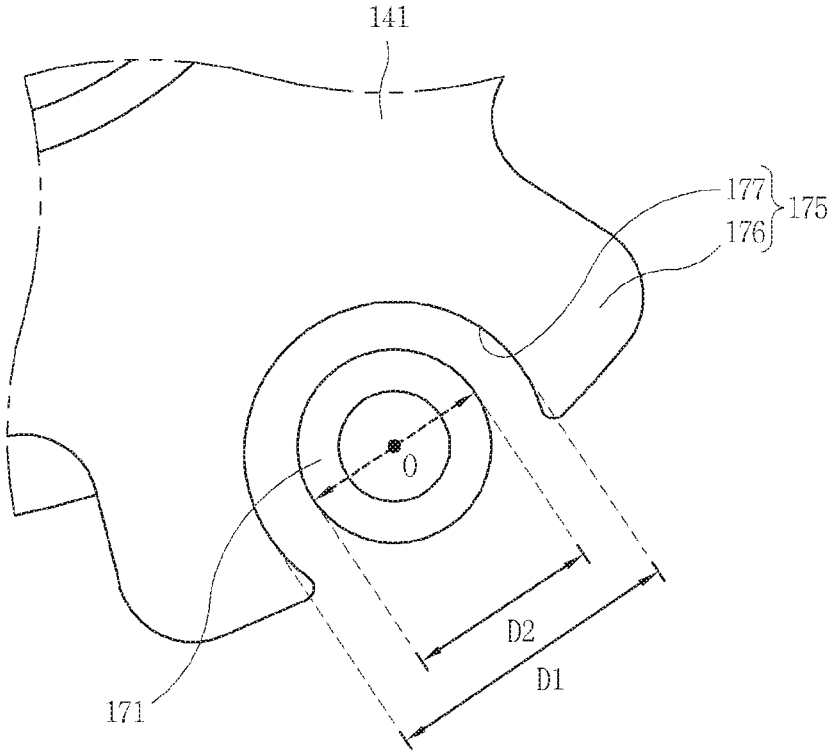
FIG. 9 is a planar view illustrating a specification of a second guide in FIG. 8.

FIG. 8 is a planar view illustrating a state in which an orbiting scroll and a non-orbiting scroll are concentrically coupled to each other, in accordance with an embodiment. FIG. 9 is a planar view illustrating a specification of a second guide in FIG. 8.

Referring to FIGS. 8 and 9, each of the second guides 175 may include guide forming portion 176 extending from the outer circumferential surface of the orbiting end plate portion 141 to protrude in the radial direction, and guide accommodating portion 177 formed through the guide forming portion 176 in the axial direction to form an anti-rotation surface together with the outer circumferential surface of the first guide 171. The guide forming portion 176 may be formed such that a circumferential length L1 of an inner end portion or end thereof connected to the outer circumferential surface of the orbiting end plate portion 141 is shorter than a circumferential length L2 of an outer end portion or end forming an outer circumferential surface thereof, in view of minimizing weight and frictional loss of the orbiting end plate portion. However, in view of reliability of the guide forming portion 176 the circumferential length L1 of the inner end portion may be equal to or longer than a half (½) of the circumferential length L2 of the outer end portion.

The guide accommodating portion 177 may form the inner circumferential surface of the guide forming portion 176 and may be formed in an arcuate shape. When the guide accommodating portion 177 is formed in the arcuate shape, a center angle of the guide accommodating portion 177 may vary depending on the number of second guides 175. That is, when the center angle formed along the circumferential surface of the guide accommodating portion 177 of two angles formed by connecting a center O of the guide accommodating portion 177 to both ends of the guide accommodating portion 177 in the circumferential direction of the guide receiving portion 177 is $\alpha$, the center angle $\alpha$ may be formed to satisfy $\{\alpha \geq (3 \times 360°)/\text{the number of second guides (n)}\}$.

For example, when the number of second guides 175 is four, the center angle of the guide accommodating portion 177 may be 270° or greater. Therefore, the number of second guides 175 may be at least four when the guide accommodating portion 177 has the arcuate shape, in view of reliability.

Figure 10:
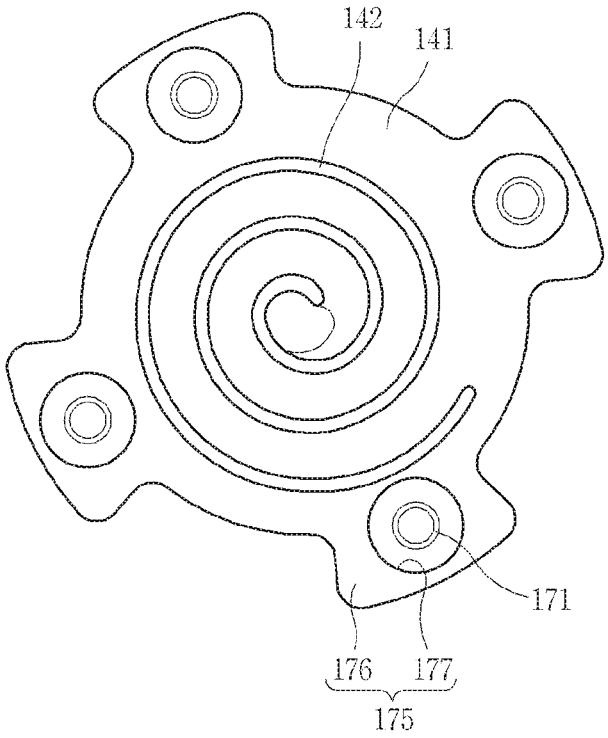
FIG. 10 is a planar view illustrating of a second guide in an orbiting scroll according to another embodiment.
Figure 11A:
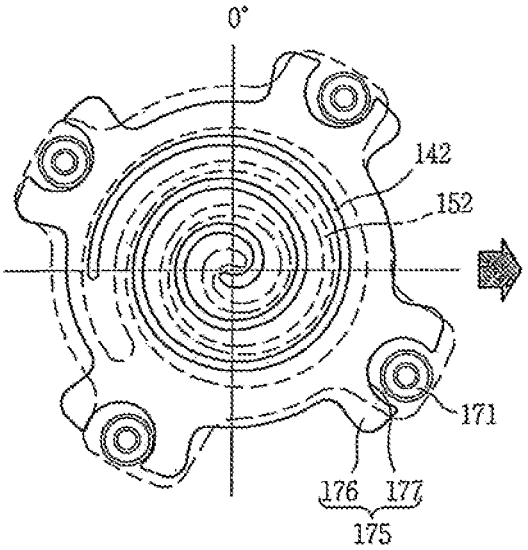
FIGS. 11A to 11D are schematic views illustrating a process in which an orbiting scroll performs an orbiting motion with respect to a non-orbiting scroll by an anti-rotation mechanism in accordance with an embodiment.
Figure 11B:
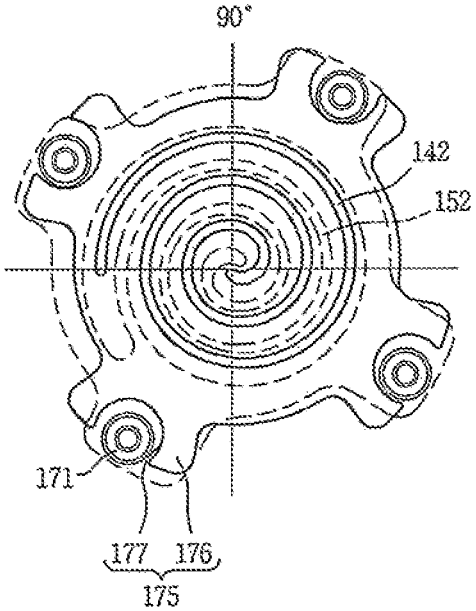
Figure 11D:
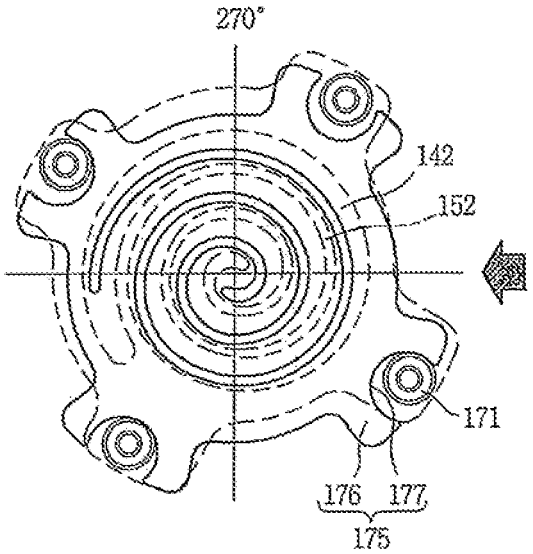
Figure 11C:
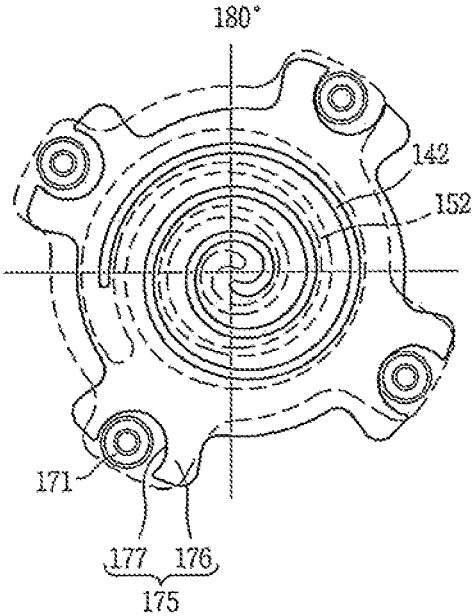

In addition, an inner diameter D1 of the guide accommodating portion 177 may be formed to be greater than an outer diameter D2 of the first guide 171, namely, an outer diameter of the bushing 173 by twice of the orbiting radius of the orbiting scroll 140. On the other hand, the guide accommodating portion 177 may also be formed in a circular shape as illustrated in FIG. 10. FIG. 10 is a planar view illustrating another embodiment of a second guide in an orbiting scroll according to embodiments.

In this case, the second guides may also be provided by four in number, as illustrated in FIG. 10. However, substituting in the equation for calculating the center angle $\alpha$ described above, the second guide 175 may be provided by three in number. For example, when the number of second guides is three, the center angle of the guide accommodating portion 177 is 360°, that is, the guide accommodating portion 177 is formed in the shape of a perfect circle (round shape).

Hereinafter, description will be given of operation effects of the anti-rotation mechanism of the scroll compressor according to embodiments.

FIGS. 11A to 11D are schematic views illustrating a process in which an orbiting scroll performs an orbiting motion with respect to a non-orbiting scroll by an anti-rotation mechanism in accordance with an embodiment. As illustrated in these drawings, in this embodiment, the first guides 171 configured as the plurality of pins 172 may be fixed between the frame 130 and the orbiting scroll 150, and then orbitally coupled to the second guides 175 which may be formed on the outer circumferential surface of the orbiting end plate portion 140.

Then, the first guides 171 and the second guides 175 form a kind of pin-and-ring structure, so that the first guides 171 serve as pins and the second guides 175 serve as rings. That is, each time a crank angle of the rotational shaft 125 rotates by 90°, the first guides 171 slide along inner circumferential surfaces of the guide accommodating portions 177 of the second guides 175. However, the first guides 171 and the second guides 175 may be formed as at least two pairs (four pairs in this embodiment). In each pair, the first guide 171 and the second guide 175 restrict rotary motion of each other.

Then, the first guide 171 performs an orbiting motion while its rotation with respect to the second guide 175 is restricted. Accordingly, the orbiting scroll with which the second guides 175 are integrally formed performs the orbiting motion with respect to the first guides 171. As the first guides 171 are fixedly coupled to the non-orbiting scroll 150, the orbiting scroll 140 eventually performs the orbiting motion with respect to the non-orbiting scroll 140.

As such, in the scroll compressor according to this embodiment, the anti-rotation mechanism is formed on the outer circumferential surface of the orbiting scroll, which is the outer side from the orbiting wrap, specifically using the guide pins (first guides) for guiding the axial movement of the non-orbiting scroll. This may result in reducing the number of components for constructing the anti-rotation mechanism, compared with an Oldham ring type or pin-and-ring type according to the related art. Accordingly, manufacturing costs of the scroll compressor including the anti-rotation mechanism may be reduced.

Also, in the scroll compressor according to embodiments, as the anti-rotation mechanism is constructed by coupling the orbiting scroll to the guide pins provided between the main frame and the non-orbiting scroll, the main frame, the non-orbiting scroll, and the orbiting scroll may be assembled together using the same members upon assembling the compressor. Accordingly, the main frame, the non-orbiting scroll and the orbiting scroll may be easily aligned at proper positions even without using or forming separate reference pins or reference holes for alignment, thereby reducing the number of components required for assembling and simultaneously simplifying the assembling process.

Figure 12:
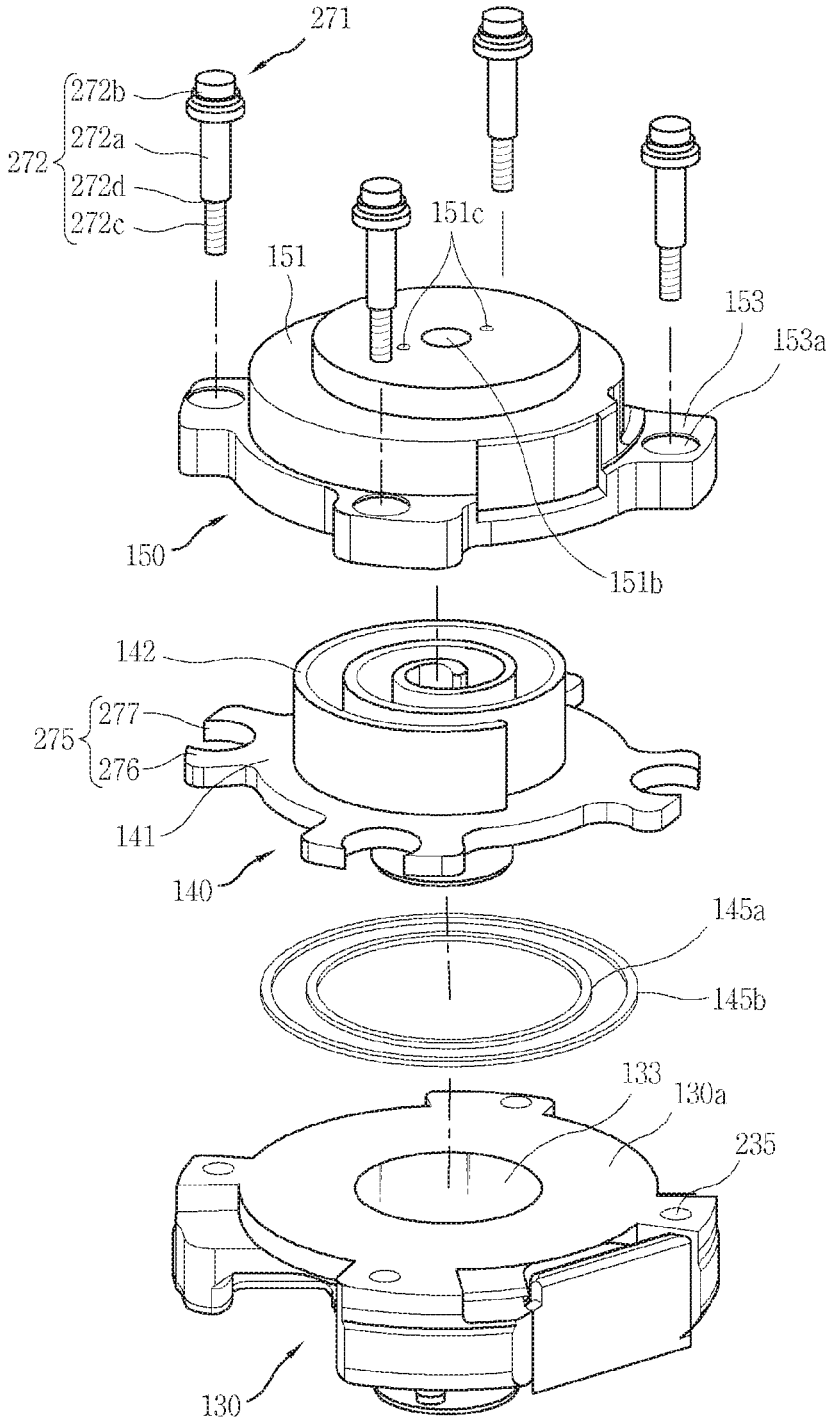
FIG. 12 is an exploded perspective view illustrating a compression device of a scroll compressor provided with an anti-rotation mechanism according to another embodiment.
Figure 13:
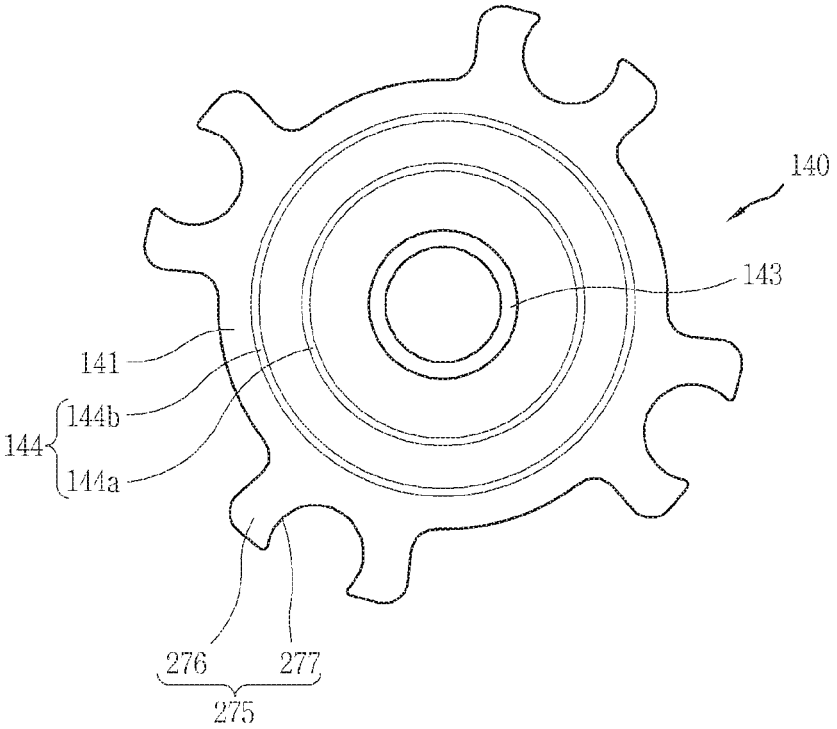
FIG. 13 is a planar view illustrating a lower surface of an orbiting scroll in the scroll compressor according to FIG. 12.
Figure 14:
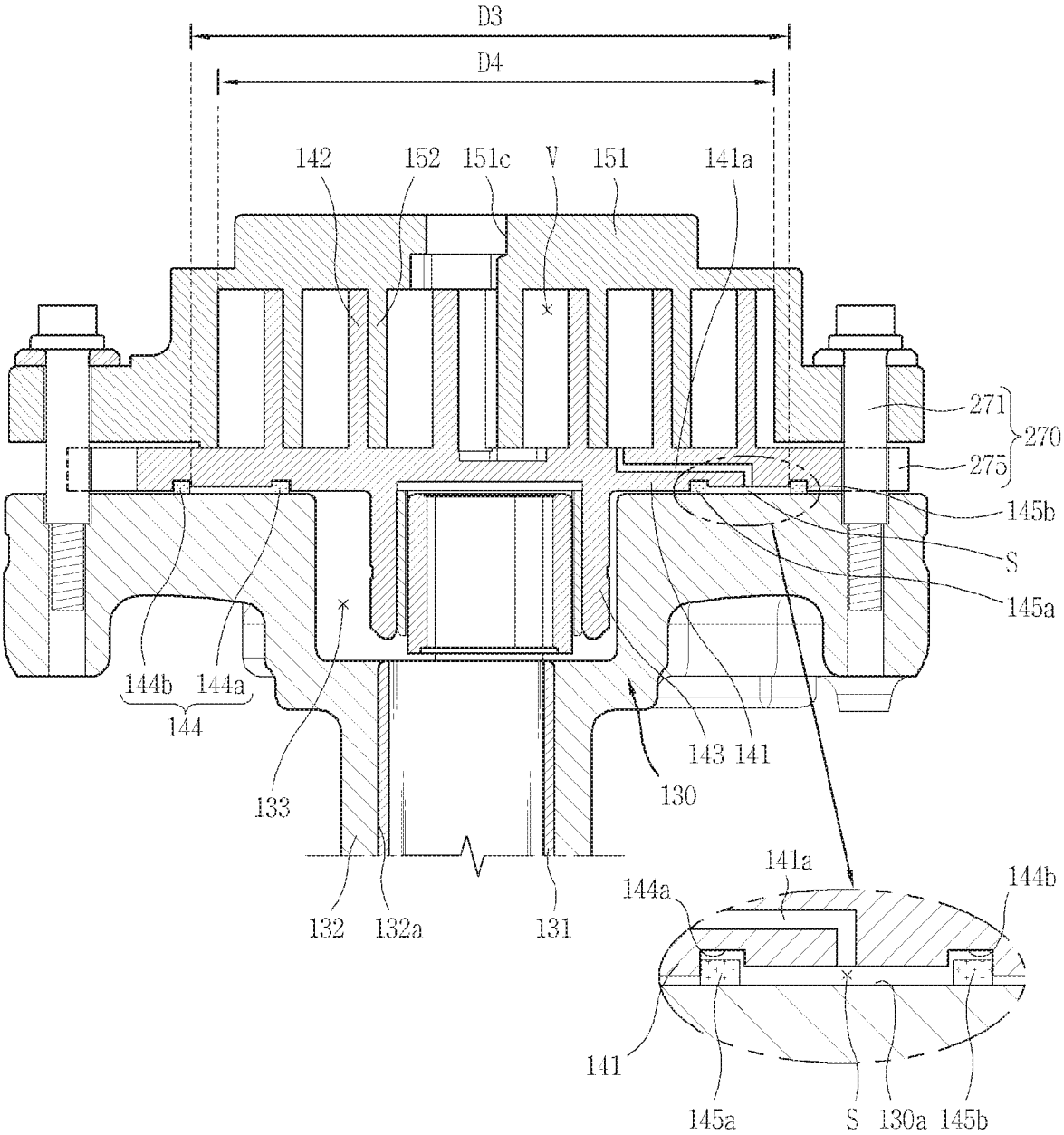
FIG. 14 is a cross-sectional view illustrating the assembled compression device of FIG. 12.
Figure 15:
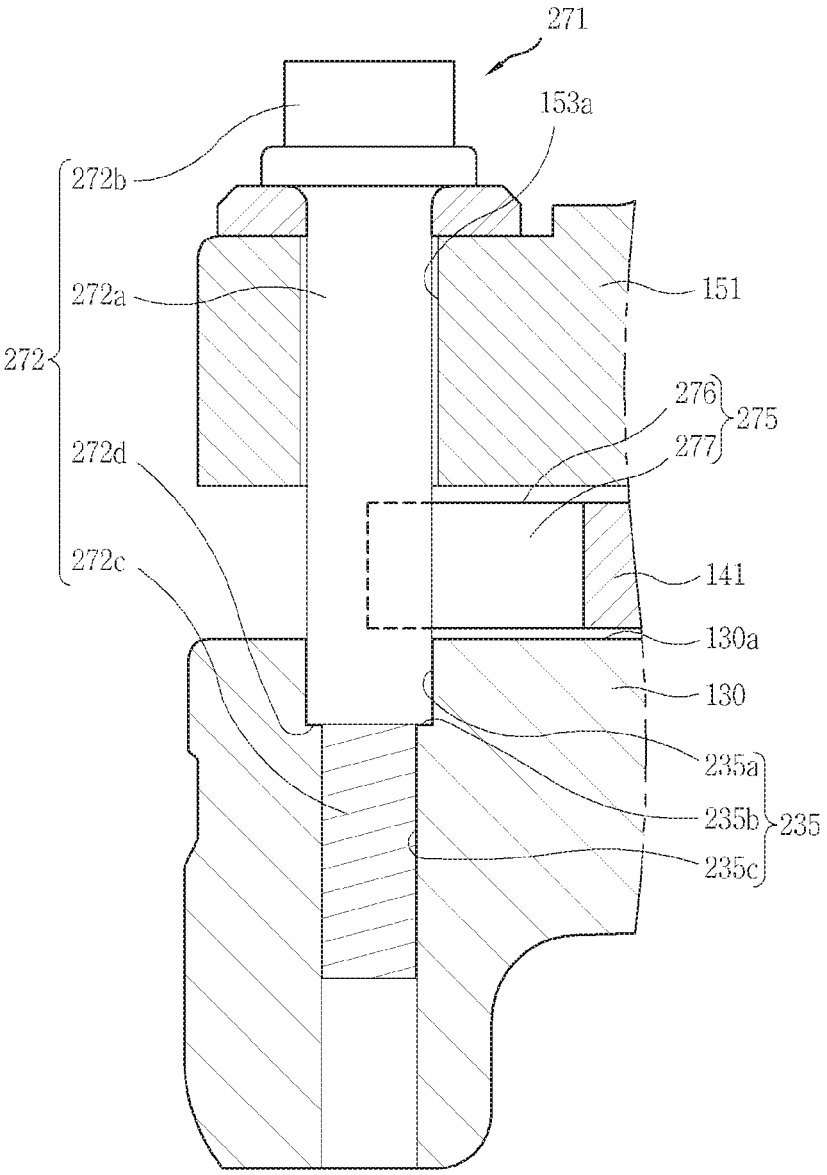
FIG. 15 is an enlarged cross-sectional view of an anti-rotation mechanism in FIG. 14.

On the other hand, the anti-rotation mechanism according to embodiments may be equally applied to an orbiting back pressure manner. FIG. 12 is an exploded perspective view illustrating a compression device of a scroll compressor provided with an anti-rotation mechanism according to another embodiment. FIG. 13 is a planar view illustrating a lower surface of an orbiting scroll in the scroll compressor according to FIG. 12. FIG. 14 is a cross-sectional view illustrating the assembled compression device of FIG. 12. FIG. 15 is an enlarged cross-sectional view of an anti-rotation mechanism in FIG. 14.

Referring to these drawings, in the scroll compressor according to an embodiment, a sealing groove 144 in an annular shape may be formed in a lower surface of the orbiting scroll 140. The sealing groove 144 may be provided with a first sealing groove 144*a* and a second sealing groove 144*b* formed along the radial direction at the outside of the boss portion 143.

A first sealing member 145*a* may be inserted into the first sealing groove 144*a*, and a second sealing member 145*b* may be inserted into the second sealing groove 144*b*. A sealed space may be formed between the first sealing member 145*a* and the second sealing member 145*b*. The sealed space between the first sealing member 145*a* and the second sealing member 145*b* may form the back pressure chamber S.

The back pressure chamber S may be formed to have an area as large as possible, in terms of stably supporting the orbiting scroll 140. Therefore, an inner diameter of the first sealing groove 144*a* may be as small as possible, and an outer diameter of the second sealing groove 144*b* may be as large as possible.

However, if the inner diameter of the first sealing groove 144*a* is made too small, the orbiting space 133 of the main frame 130 and the first sealing groove 144*a* may interfere with each other during the orbiting motion of the orbiting scroll 140. Accordingly, the back pressure chamber S and the orbiting space 133 communicate with each other and thus the back pressure chamber S may not be sealed. Therefore, the first sealing groove 144*a* may be formed outward from the orbiting space 133 by an orbiting radius, and the second sealing groove 144*b* may be formed inward by the orbiting radius from an outer diameter of thrust surface 130*a* between the orbiting end plate portion 141 and the main frame 130. For example, as illustrated in FIG. 14, an inner diameter D3 of the second sealing groove 144*b* may be greater than an inner diameter D4 of an inner surface of the outermost side of the non-orbiting wrap 152. Accordingly, the outer diameter of the back pressure chamber S which is the same as the inner diameter D3 of the second sealing groove 144*b* is greater than the inner diameter D4 of the outermost side of the non-orbiting wrap 152, and thus, the area of the back pressure chamber S may be increased by that much.

In this case, the orbiting end plate portion 141 may be provided with back pressure hole 141*a* for guiding a refrigerant of intermediate pressure into the back pressure chamber S. The back pressure hole 141*a* may be made smaller than a wrap thickness of the non-orbiting wrap 152, so as to be completely covered by the non-orbiting wrap 152 when the non-orbiting wrap 152 overlaps the back pressure hole 141*a*, thereby preventing leakage between compression chambers.

On the other hand, when the back pressure chamber S is formed between the main frame 130 and the orbiting scroll 140 as illustrated in this embodiment, the back pressure chamber assembly in the foregoing embodiment is not needed. Then, the non-orbiting scroll 150 does not have to slide axially relative to the orbiting scroll 140. Therefore, the non-orbiting scroll 150 may be fixedly coupled to the main frame 130 by first guides 271. Accordingly, unlike the foregoing embodiment, the first guide 271 may be provided only with the pin without the bushing.

For example, as illustrated in FIG. 15, in an anti-rotation mechanism 270 according to this embodiment, first guide 271 may be provided with a pin 272 inserted through the guide hole 153*a* of the non-orbiting end plate portion 150 to be coupled to the main frame 130. The pin 272 may include a pin portion 272*a* substantially constituting the first guide, a fixing head portion 272*b* provided on one or a first end of the pin portion 272*a* to be supported axially by the non-orbiting end plate portion 151, a first coupling screw portion 272*c* provided on another or a second end of the pin portion 272*a* to be coupled to the coupling hole 135 of the main frame 130, and a first stepped portion 272*d* provided on the pin portion 272*a* between the fixing head portion 272*b* and the first coupling screw portion 272*c* to be supported axially by the main frame 130.

The fixing head portion 272*b* and the first coupling screw portion 272*c* may be substantially the same as those in the previous embodiment, so detailed description thereof has been omitted. Also, the pin portion 272*a* may be similar to that illustrated in the previous embodiment. However, the pin portion 272*a* according to this embodiment is different from the pin portion 272*a* according to the previous embodiment which is formed to have the same or almost the same diameter, in that the first stepped portion 272*d* is formed on a portion where the first coupling screw portion 272*c* is started. Therefore, the pin portion 272*a* has a greater outer diameter than an outer diameter of the first coupling screw portion 272*c*, and a difference between the outer diameter of the pin portion 272*a* and the outer diameter of the first coupling screw portion 272*c* is the same as an area of the first stepped portion 272*d*.

The main frame 130 may be provided with a second coupling screw portion 235 to which the first coupling screw portion 272*c* of the pin 272 may be coupled. The second coupling screw portion 235 may be formed as a coupling hole as in the previous embodiment.

In addition, a support groove 235*a* in which a portion of the pin 272, namely, a portion of the pin portion 272*a* where the first stepped portion 272*d* is started may be formed in one side of the second coupling screw portion 235, and a second stepped portion 235*b* for axially supporting the first stepped portion 272*d* may be formed between the second coupling screw portion 235 and the support groove 235*a*. Accordingly, an inner diameter of the support groove 235*a* may be greater than an inner diameter of the second coupling screw portion 272*d*. That is, in the pin 272 according to this embodiment, an outer diameter of the pin portion 272*a* may be greater than an outer diameter of the first coupling screw portion 272*c*. Accordingly, it may be advantageous, in view of stability, to support the orbiting scroll in the radial direction by inserting the pin portion 272*a* into the support groove 235*a*, as compared to the case of supporting the orbiting scroll in the radial direction by coupling the first coupling screw portion 272*c* to the second coupling screw portion 235.

The second guide 275 may be formed to be the same as the second guide 175 of the previous embodiment. That is, the second guide 275 may be provided with guide forming portion 276 and guide accommodating portion 277. Therefore, the second guide 275 according to this embodiment may be replaced by the second guide 175 according to the previous embodiment.

As described above, instead of excluding the anti-rotation mechanism from the thrust surface 130*a* formed between the main frame 130 and the orbiting scroll 140, that is, formed by the upper surface of the main frame 130 and the lower surface of the orbiting scroll 140, when the anti-rotation mechanism is disposed at the outside of the orbiting scroll 140, the back pressure chamber S may be formed on the thrust surface 130*a* between the main frame 130 and the orbiting scroll 140. Accordingly, the back pressure chamber S may be formed to have an outer diameter as wide as possible, so as to obtain an increased area. Then, as a region subjected to pressure of the back pressure chamber S is widely distributed on the lower surface of the orbiting end plate portion 141, the orbiting scroll 130 may be stably supported. Also, the behavior of the orbiting scroll may be stabilized, and thus, a gap generated between the orbiting scroll and the non-orbiting scroll may be reduced, thereby increasing compression efficiency.

Embodiments disclosed herein provide a scroll compressor, capable of easily and simply forming an anti-rotation mechanism for preventing rotation of an orbiting scroll, thereby reducing manufacturing costs. Also, embodiments disclosed herein provide a scroll compressor, capable of facilitating assembly of a frame, a non-orbiting scroll, and an orbiting scroll.

Embodiments disclosed herein further provide a scroll compressor, capable of assembling a frame, a non-orbiting scroll, and an orbiting scroll with a same member so as to facilitate alignment during assembly. Embodiments disclosed herein furthermore provide a scroll compressor, capable of reducing the number of components for operating the compressor while forming a back pressure chamber at a rear surface of a non-orbiting scroll, thereby reducing manufacturing costs.

Embodiments disclosed herein also provide a scroll compressor, capable of ensuring a wide volume of a back pressure chamber while forming the back pressure chamber between an orbiting scroll and a frame. Embodiments disclosed herein additionally provide a scroll compressor, capable of stabilizing behavior of an orbiting scroll while forming a back pressure chamber between the orbiting scroll and a frame, thereby preventing leakage between compression chambers.

Embodiments disclosed herein provide a scroll compressor that may include a non-orbiting scroll having a non-orbiting wrap, an orbiting scroll having an orbiting wrap engaged with the non-orbiting scroll to form a compression chamber, and performing an orbiting motion, a guide provided at the non-orbiting scroll, and a guide accommodating portion provided in an outer circumferential surface of the orbiting scroll and accommodating the guide, so that the orbiting scroll performs the orbiting motion with respect to the guide. The guide may be located radially outward from the non-orbiting wrap, and the guide accommodating portion may be located radially outward from the orbiting wrap.

A plurality of the guide may be provided spaced apart by preset or predetermined intervals in a circumferential direction. A plurality of the guide accommodating portion may be provided to accommodate the plurality of guides, respectively, and spaced apart by preset or predetermined intervals along the circumferential direction.

Embodiments disclosed herein may further provide a scroll compressor that may include a frame, a non-orbiting scroll provided with a non-orbiting end plate portion or plate coupled to one side of the frame in an axial direction of the frame, and a non-orbiting wrap formed on a side surface of the non-orbiting end plate portion in the axial direction, an orbiting scroll provided with an orbiting end plate portion or plate located between the frame and the non-orbiting scroll, and an orbiting wrap formed on a side surface of the orbiting end plate portion in the axial direction and engaged with the non-orbiting wrap to form a compression chamber, a plurality of first guides disposed between the frame and the non-orbiting scroll so as to be located outward from the non-orbiting wrap in a radial direction, and spaced apart by preset or predetermined intervals along a circumferential direction, and a plurality of second guides provided on the orbiting end plate portion to be located radially outward from the orbiting wrap, spaced apart by preset or predetermined intervals along the circumferential direction to be coupled to the first guides, respectively, so as to allow an orbiting motion of the orbiting scroll together with the first guides. The second guides may extend to protrude radially from an outer circumferential surface of the orbiting end plate portion.

The second guides may be formed inward from an outer circumferential surface of the orbiting end plate portion. The second guides may be formed in the orbiting end plate portion through which the first guides may be inserted in the axial direction.

Each of the second guides may be provided with a guide accommodating portion formed on an inner circumferential surface thereof to surround the first guide, and an inner diameter of the guide accommodating portion may be greater than an outer diameter of the first guide by twice of an orbiting radius of the orbiting scroll. The guide accommodating portion may be formed in an arcuate shape.

A center angle may satisfy $\{\alpha \geq (3\times360°)/\text{the number of second guides (n)}\}$, when the center angle formed by connecting a center of the guide accommodating portion to both ends of the guide accommodating portion in the circumferential direction is $\alpha$. The guide accommodating portion may be formed in a circular shape.

Each of the first guides may include a pin member or pin slidably inserted through the non-orbiting end plate portion in the axial direction to be coupled to the frame, and a bush member or bushing inserted into an outer circumferential surface of the pin member to be disposed between the frame and the non-orbiting scroll. The bush member may have both ends disposed to face one surface of the frame and one surface of the non-orbiting scroll, respectively, to support the frame and the non-orbiting scroll.

Each of the first guides may include a pin member slidably inserted through the non-orbiting end plate portion in the axial direction to be coupled to the frame. The pin member may include a pin portion, a fixing head portion provided on one or a first end of the pin portion to be axially supported by the non-orbiting end plate portion, a first coupling screw portion provided on another or a second end of the pin portion to be coupled to the frame, and a first stepped portion provided on the pin portion between the fixing head portion and the first coupling screw portion to be supported by the frame in the axial direction.

The frame may be provided with a second coupling screw portion to which the first coupling screw portion of the pin member may be coupled, and the second coupling screw portion may be provided with a second step portion formed in one side thereof to axially support the first stepped portion of the pin member inserted into the second coupling screw portion.

A back pressure chamber assembly having a back pressure chamber may be coupled to an upper surface of the non-orbiting scroll. The non-orbiting scroll and the back pressure chamber assembly may be provided with back pressure holes through which the back pressure chamber and the compression chamber may communicate with each other.

A back pressure chamber may be formed between the main frame and the orbiting scroll in a manner that a plurality of sealing members is spaced apart by a preset or predetermined interval in the radial direction. The orbiting scroll may be provided with a back pressure hole through which the compression chamber and the back pressure chamber may communicate with each other. An inner diameter of a sealing member located at an outer side among the plurality of sealing members may be equal to or greater than an inner diameter of an outermost side of the non-orbiting wrap.

Embodiments disclosed herein also provide a scroll compressor that may include a frame, a non-orbiting scroll coupled to one side of the frame in an axial direction of the frame, an orbiting scroll disposed between the frame and the non-orbiting scroll to form a compression chamber with the non-orbiting scroll while performing an orbiting motion, and an anti-rotation mechanism provided between the frame and the orbiting scroll to suppress a rotary motion of the orbiting scroll with respect to the non-orbiting scroll. The anti-rotation mechanism may include a first guide provided between the frame and the non-orbiting scroll to mutually restrict the frame and the non-orbiting scroll in a radial direction, and a second guide provided at the orbiting scroll and having a guide accommodation portion surrounding the first guide to be orbitally movable.

The orbiting scroll may be provided with an orbiting wrap extending from an orbiting end plate portion or plate in the axial direction to form the compression chamber. The second guide may extend radially from the orbiting end plate portion and may be located radially outward from the orbiting wrap.

In a scroll compressor according to embodiments, an anti-rotation mechanism may be formed using guide pins formed in an outer circumferential surface of an orbiting scroll, which is located outward from an orbiting wrap, to guide axial movement of a non-orbiting scroll, thereby eliminating an addition of separate components for the anti-rotation mechanism. Accordingly, such components for the anti-rotation mechanism may be excluded, thereby reducing manufacturing costs of the scroll compressor including the anti-rotation mechanism.

Also, in the scroll compressor according to embodiments, as the anti-rotation mechanism is constructed by coupling the orbiting scroll to guide members provided between a main frame and the non-orbiting scroll, the main frame, the non-orbiting scroll, and the orbiting scroll may be assembled together using the same members upon assembling the compressor. Accordingly, the main frame, the non-orbiting scroll, and the orbiting scroll may be easily aligned and assembled without using separate members for aligning those components. This may result in simplifying an assembling process.

In addition, in the scroll compressor according to embodiments, as the anti-rotation mechanism is not provided between the main frame and the orbiting scroll, a back pressure chamber may be formed between the main frame and the orbiting scroll. Accordingly, the back pressure chamber may be formed to have an outer diameter as great as possible, and thus, obtain an increased area. Thus, the orbiting scroll may be stably supported, thereby enhancing compression efficiency of the compressor.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a frame;

a non-orbiting scroll provided with a non-orbiting end plate coupled to one side of the frame in an axial direction of the frame, and a non-orbiting wrap formed on a side surface of the non-orbiting end plate in the axial direction;

an orbiting scroll provided with an orbiting end plate located between the frame and the non-orbiting scroll, and an orbiting wrap formed on a side surface of the orbiting end plate in the axial direction and engaged with the non-orbiting wrap to form a compression chamber;

a plurality of first guides disposed between the frame and the non-orbiting scroll so as to be located outward from the non-orbiting wrap in a radial direction, and spaced apart by predetermined intervals in a circumferential direction; and a plurality of second guides provided on the orbiting end plate to be located radially outward from the orbiting wrap, spaced apart by predetermined intervals along the circumferential direction to be coupled to the plurality of first guides, respectively, so as to allow an orbiting motion of the orbiting scroll together with the plurality of second guides, wherein each of the plurality of second guides includes a guide forming portion that extends from an outer circumferential surface of the orbiting end plate to protrude in the radial direction, and a guide accommodating portion formed through the guide forming portion in the axial direction to form an anti-rotation surface together with an outer circumferential surface of a respective first guide of the plurality of first guides, and wherein the guide forming portion is formed such that a circumferential length of an inner end portion connected to the outer circumferential surface of the orbiting end plate is shorter than a circumferential length of an outer end portion forming an outer circumferential surface of the guide forming portion.

2. The compressor of claim 1, wherein the plurality of first guides is inserted through the plurality of second guides in the axial direction.

3. The compressor of claim 2, wherein each of the plurality of second guides is provided with the guide accommodating portion formed on an inner circumferential surface thereof to surround the respective first guide of the plurality of first guides, and an inner diameter of the guide accommodating portion is greater than an outer diameter of the respective first guide by twice an orbiting radius of the orbiting scroll.

4. The compressor of claim 3, wherein the guide accommodating portion is formed in an arcuate shape.

5. The compressor of claim 4, wherein a center angle of the guide accommodating portion satisfies $\{\alpha \geq (3\times360°)/\text{the number of second guides (n), n=3 to 5}\}$, wherein the center angle formed by connecting a center of the guide accommodating portion to both ends of the guide accommodating portion in the circumferential direction is α.

6. The compressor of claim 3, wherein the guide accommodating portion is formed in a circular shape.

7. The compressor of claim 1, wherein each of the plurality of first guides comprises:

a pin slidably inserted through the non-orbiting end plate in the axial direction to be coupled to the frame; and a bushing inserted into an outer circumferential surface of the pin to be disposed between the frame and the non-orbiting scroll.

8. The compressor of claim 7, wherein both ends of the bushing is disposed to face one surface of the frame and one surface of the non-orbiting scroll, respectively, to support the frame and the non-orbiting scroll.

9. The compressor of claim 1, wherein each of the first guides comprises a pin slidably inserted through the non-orbiting end plate in the axial direction to be coupled to the frame, and wherein the pin comprises:

a pin portion;

a head portion provided at a first end of the pin portion to be axially supported by the non-orbiting end plate;

a first coupling screw portion provided at a second end of the pin portion to be coupled to the frame; and a first stepped portion provided on the pin portion between the head portion and the first coupling screw portion to be supported by the frame in the axial direction.

10. The compressor of claim 9, wherein the frame is provided with a second coupling screw portion to which the first coupling screw portion of the pin is coupled, and the second coupling screw portion is provided with a second step portion formed in one side thereof to axially support the first stepped portion of the pin inserted into the second coupling screw portion.

11. The compressor of claim 1, wherein a back pressure chamber assembly having a back pressure chamber is coupled to an upper surface of the non-orbiting scroll, and wherein the non-orbiting scroll and the back pressure chamber assembly are provided with back pressure holes through which the back pressure chamber and the compression chamber communicate with each other.

12. The compressor of claim 1, wherein a back pressure chamber is formed between the frame and the orbiting scroll in a manner that a plurality of sealing members is spaced apart by a predetermined interval in the radial direction, and wherein the orbiting scroll is provided with a back pressure hole through which the compression chamber and the back pressure chamber communicate with each other.

13. The compressor of claim 12, wherein an inner diameter of a sealing member located at an outer side among the plurality of sealing members is equal to or greater than an inner diameter of an outermost side of the non-orbiting wrap.

14. The compressor of claim 1, wherein the circumferential length of the inner end portion of the guide forming portion is equal to or longer than a half of the circumferential length of the outer end portion of the guide forming portion.

15. A scroll compressor, comprising:

a non-orbiting scroll having a non-orbiting wrap;

an orbiting scroll having an orbiting wrap engaged with the non-orbiting wrap to form a compression chamber, the orbiting scroll performing an orbiting motion;

a plurality of guides provided at the non-orbiting scroll; and a plurality of guide accommodating portions provided in an outer circumferential surface of the orbiting scroll and accommodating the plurality of guides, respectively so that the orbiting scroll performs the orbiting motion with respect to the plurality of guides, wherein each of the plurality of guide accommodating portions includes a guide forming portion that extends from the outer circumferential surface of the orbiting scroll to protrude in a radial direction, and a recess recessed from an outer circumferential surface of the guide forming portion in the radial direction and formed through the guide forming portion in an axial direction to form an anti-rotation surface together with an outer circumferential surface of a respective guide of the plurality of guides, and wherein each of the plurality of guide accommodating portions is formed such that a distance between both ends of the guide accommodating portion in a circumferential direction is less than an inner diameter of the guide accommodating portion.

16. The compressor of claim 15, wherein the plurality of guides is located outward from the non-orbiting wrap in the radial direction, and wherein the plurality of guide accommodating portions is located outward from the orbiting wrap in the radial direction.

17. The compressor of claim 16, wherein the plurality of guides is spaced apart by predetermined intervals in the circumferential direction, and the plurality of guide accommodating portions is spaced apart by predetermined intervals in the circumferential direction.

18. The compressor of claim 16, wherein each of the plurality of guides comprises a pin provided at the non-orbiting scroll, and each of the plurality of guide accommodating portions comprises the recess formed at the outer circumferential surface of the orbiting scroll and accommodating a respective pin of the plurality of pins so that the orbiting scroll performs the orbiting motion with respect to the plurality of pins.

19. A scroll compressor, comprising:

a frame;

a non-orbiting scroll coupled to one side of the frame in an axial direction of the frame;

an orbiting scroll disposed between the frame and the non-orbiting scroll to form a compression chamber with the non-orbiting scroll while performing an orbiting motion; and an anti-rotation mechanism provided between the frame and the orbiting scroll to suppress a rotary motion of the orbiting scroll with respect to the non-orbiting scroll, wherein the anti-rotation mechanism comprises:

at least one first guide provided between the frame and the non-orbiting scroll to mutually restrict the frame and the non-orbiting scroll in a radial direction; and at least one second guide provided at the orbiting scroll and including at least one guide accommodation portion surrounding the at least one first guide to be orbitally movable, wherein the orbiting scroll is provided with an orbiting wrap that extends from an orbiting end plate in the axial direction to form the compression chamber, wherein the at least one second guide extends radially from the orbiting end plate and is located radially outward from the orbiting wrap, and wherein a center angle (α) of the at least one second guide is greater than 180°, wherein the center angle is an angle formed by connecting a center of the at least one second guide to both ends of the at least one second guide in a circumferential direction.

20. The compressor of claim 19, wherein the at least one first guide comprises at least one pin provided at the non-orbiting scroll, and the at least one second guide comprises at least one corresponding recess formed at an outer circumferential surface of the orbiting scroll and accommodating the at least one pin so that the orbiting scroll performs the orbiting motion with respect to the at least one pin.

* * * * *